US006924718B2

(12) United States Patent
Snyder

(10) Patent No.: US 6,924,718 B2
(45) Date of Patent: Aug. 2, 2005

(54) COUPLING PROBE HAVING AN ADJUSTABLE TUNING CONDUCTOR

(75) Inventor: Richard V. Snyder, Kinnelon, NJ (US)

(73) Assignee: RS Microwave Company, Butler, NJ (US)

( * ) Notice: Subject to any disclaimer, the term of this patent is extended or adjusted under 35 U.S.C. 154(b) by 0 days.

(21) Appl. No.: 10/724,842

(22) Filed: Dec. 1, 2003

(65) Prior Publication Data

US 2004/0108919 A1 Jun. 10, 2004

Related U.S. Application Data

(60) Provisional application No. 60/430,909, filed on Dec. 4, 2002.

(51) Int. Cl.[7] ..... H01P 1/20

(52) U.S. Cl. ..... 333/202; 333/212; 333/230

(58) Field of Search ..... 333/202, 212, 333/230

(56) References Cited

U.S. PATENT DOCUMENTS 3,516,030 A * 6/1970 Brumbelow ..... 333/212
5,220,300 A 6/1993 Snyder
5,608,363 A * 3/1997 Cameron et al. ..... 333/202
6,150,907 A * 11/2000 Loi et al. ..... 333/212

* cited by examiner

*Primary Examiner*—Benny Lee
(74) *Attorney, Agent, or Firm*—RatnerPrestia

(57) ABSTRACT

A filtering system with a probe for coupling two resonators includes an iris having the probe disposed therein coupled between the two resonators. The probe has a transverse opening for receiving a tuning conductor, and the tuning conductor provides adjustable coupling between the two resonators.

21 Claims, 14 Drawing Sheets

COUPLING PROBE HAVING AN ADJUSTABLE TUNING CONDUCTOR

CROSS REFERENCE TO RELATED APPLICATIONS

This application claims the benefit of U.S. Provisional Application No. 60/430,909, filed Dec. 4, 2002, which is hereby incorporated by reference in its entirety.

TECHNICAL FIELD

The present invention relates to microwave filters, and more specifically, to tunable coupling between resonators.

BACKGROUND OF THE INVENTION

In the design of RF and microwave filters, it may be necessary to provide coupling between resonators. This is true for both bandpass and bandstop filter networks. The principles of network synthesis are used to determine the required values for the coupling coefficients, normally considered as frequency invariant numerical ratios, relative to a unit input level.

Because the coupling elements normally consist of either inductive or capacitive elements, or combinations of inductive, capacitive and resistive elements, the actual measured values of coupling are indeed frequency dependent. This difference between the assumed frequency independence and the actual frequency dependence causes the response of the fabricated filter to differ from the theoretical design.

It is possible to account for the frequency dependence of the coupling elements, within the original design. This tends to reduce the difference between the initial design and the actual fabricated filter. However, the degree of control required for the values of the coupling elements is so great as to significantly increase the fabrication cost. Tolerances have to be extremely tight and this is not normally practical.

To alleviate this problem it is desirable to have coupling mechanisms that are capable of adjustment during the filter tuning process. One method for achieving a significant range for realizing tunable couplings is taught by Snyder (U.S. Pat. No. 5,220,300). This method employs short evanescent waveguide sections, resonated as appropriate, to achieve either positive (inductive) or negative (capacitive) phase shift and, thus, realizes appropriately either inductive or capacitive coupling. The method requires that the short evanescent waveguide section be resonated (using a capacitance disposed across the short section) above the filter center frequency for achieving inductive coupling, and below the filter center frequency for achieving capacitive coupling. The length of the short evanescent section interacts with the resonating capacitance. The shorter the length, the larger the required capacitor. Small values of coupling use longer coupling lengths. Large values of coupling require short coupling lengths. Large capacitors tend to have low values of Q, and, thus, contribute to high filter insertion losses. Given that the mechanical design sometimes necessitates very short lengths in the coupling regions, it is desirable to have other methods for tuning the couplings to achieve large values of coupling, without the use of large resonating capacitors, or to achieve small values of coupling in a short length. Tunable couplings should also be capable of achieving either inductive or capacitive couplings, as required in the initial synthesis.

A conventional method for achieving capacitive coupling uses a capacitive probe. This is essentially an insulated section, typically supported by a dielectric sleeve within an iris opening, with the probe having proximity to both capacitively coupled resonating rods. The probe is long enough to reach from one resonating rod to the other, with a small capacitive gap between the end of the probe and the resonating rod. The capacitance is thus fixed, determined by the spacing between the end of the probe and the resonating rod. A conventional method for providing inductive coupling between resonating rods employs a similar probe, but with the probe ends terminated in a grounded loop of wire. Current flows in the loop to ground, and the concomitant magnetic field provides inductive coupling from the probe to the resonating rod, and thus from one resonating rod to the other. Again, the value for the inductive coupling is essentially fixed by the length and gauge of the grounded loop, and the proximity of the loop to the given resonating rod.

A conventional capacitive probe, generally designated as 10, is shown in FIG. 1. As shown, resonating rod 12 is separated from resonating rod 16 by septum 19. End 14*a* of resonating rod 12 is grounded and other end 14*b* is open circuited. Similarly, end 18*a* of resonating rod 16 is grounded and other end 18*b* is open circuited.

Septum 19 includes an iris opening (not labeled) for supporting probe 13, the probe being insulated from septum 19 by dielectric sleeve 15 made of Teflon. As shown, the probe is long enough to reach from resonating rod 12 to resonating rod 16 with small capacitive gaps between the ends of the probe and the resonating rods. The capacitance is thus fixed, and is determined by the spacing between the ends of the probe and the resonating rods.

An equivalent circuit of capacitive probe 10 is shown in FIG. 2 and is generally designated as 20. As shown, the equivalent circuit includes capacitor 22, transmission line 24 and capacitor 26 connected in series.

Referring to FIG. 3, there is shown a conventional inductive probe, generally designated as 30. As shown, resonating rods 32 and 36 are separated by septum 39. End 34*a* of resonating rod 32 is grounded and other end 34*b* of resonating rod 32 is open circuited. Similarly, resonating rod 36 includes end 38*a* which is grounded, and other end 38*b* which is open circuited. As shown, probe 33 is inserted in an iris of septum 39 and is insulated from the septum by dielectric sleeve 35, the latter being sandwiched between the septum and the probe. Each end of probe 33 is grounded by a grounded loop of wire. Current flows in the loop to ground, which generates a magnetic field and provides inductive coupling from the probe to each of resonating rod 32 and resonating rod 36.

An equivalent circuit 40 of inductive probe 30 is shown in FIG. 4. As shown, coil 42, with one end grounded, is connected in series with transmission line 44 and coil 46. Similar to coil 42, coil 46 has one end grounded and another end coupled to transmission line 44.

The transmission line forming the body of each probe, whether capacitive or inductive, cannot be avoided. It is essentially a coaxial line, including a probe and a dielectric sleeve for the probe, which is inserted in an opening of a wall (septum) separating two resonating rods. The transmission line length and impedance value result in a frequency variation in coupling to each resonating rod, causing even further deviation from a desired coupling coefficient. Accordingly, a tunable coupling, or an adjustable coupling between the probe and the resonating rods is very desirable. The present invention addresses such adjustable tunable couplers.

SUMMARY OF THE INVENTION

To meet this and other needs, and in view of its purposes, the present invention provides a filtering system having a probe for coupling two resonators includes an iris having the probe disposed therein coupled between the two resonators, and the probe having a transverse opening for receiving a tuning conductor. The tuning conductor provides adjustable coupling between the two resonators. The tuning conductor is grounded at one end and provides a capacitive coupling to ground between the two resonators. The tuning conductor is transversely oriented to the probe, and fixedly movable in the transverse opening of the probe to provide an adjustable capacitance between the two resonators.

In another embodiment, the present invention provides a filtering system having a plurality of resonators including at least one probe extending between two resonators of the plurality of resonators, and a tuning conductor transversely oriented to the probe. The tuning conductor provides adjustable coupling between the two resonators. The tuning conductor is grounded at one end and provides a variable capacitance to ground between the two resonators. The tuning conductor is received in a transverse opening of the probe, and the tuning conductor is electrically insulated from the probe. The two resonators are separated by a septum, and the septum includes an iris for supporting the probe between the two resonators.

Each of the two resonators may include a resonating rod disposed in a waveguide section. Each of the two resonators may include a dielectric resonator disposed in a resonating cavity. Each of the two resonators may include a resonating cavity.

It is understood that the foregoing general description and the following detailed description are exemplary, but are not restrictive, of the invention.

BRIEF DESCRIPTION OF THE DRAWING

The invention is best understood from the following detailed description when read in connection with the accompanying drawing. Included in the drawing are the following figures.

DETAILED DESCRIPTION OF THE INVENTION

Figure 1:
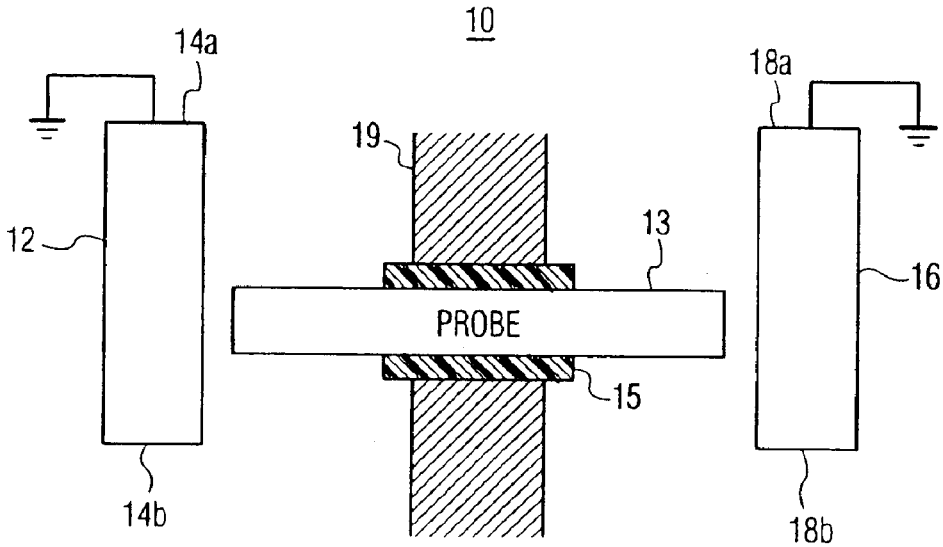
FIG. 1 PRIOR ART
FIG. 1 is a cross sectional view of a conventional probe extending between two resonating rods.
Figure 2:
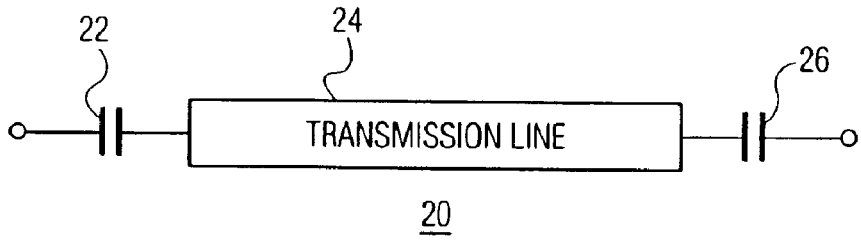
FIG. 2 PRIOR ART
FIG. 2 is an equivalent circuit of the conventional probe shown in FIG. 1.
Figure 3:
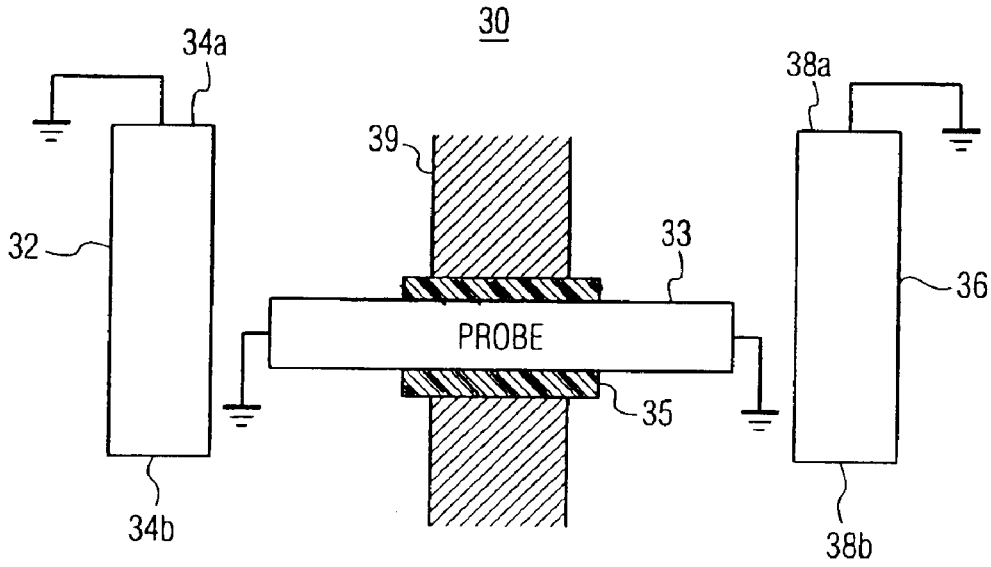
FIG. 3 PRIOR ART
FIG. 3 is a cross sectional view of another conventional probe extending between two resonating rods.
Figure 4:
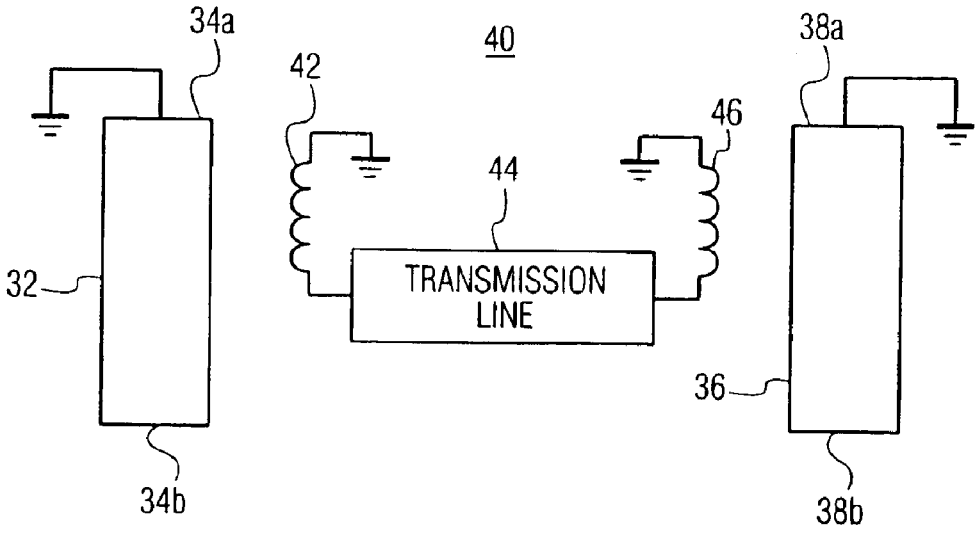
FIG. 4 PRIOR ART
FIG. 4 is an equivalent circuit of the conventional probe shown in FIG. 3.
Figure 5A:
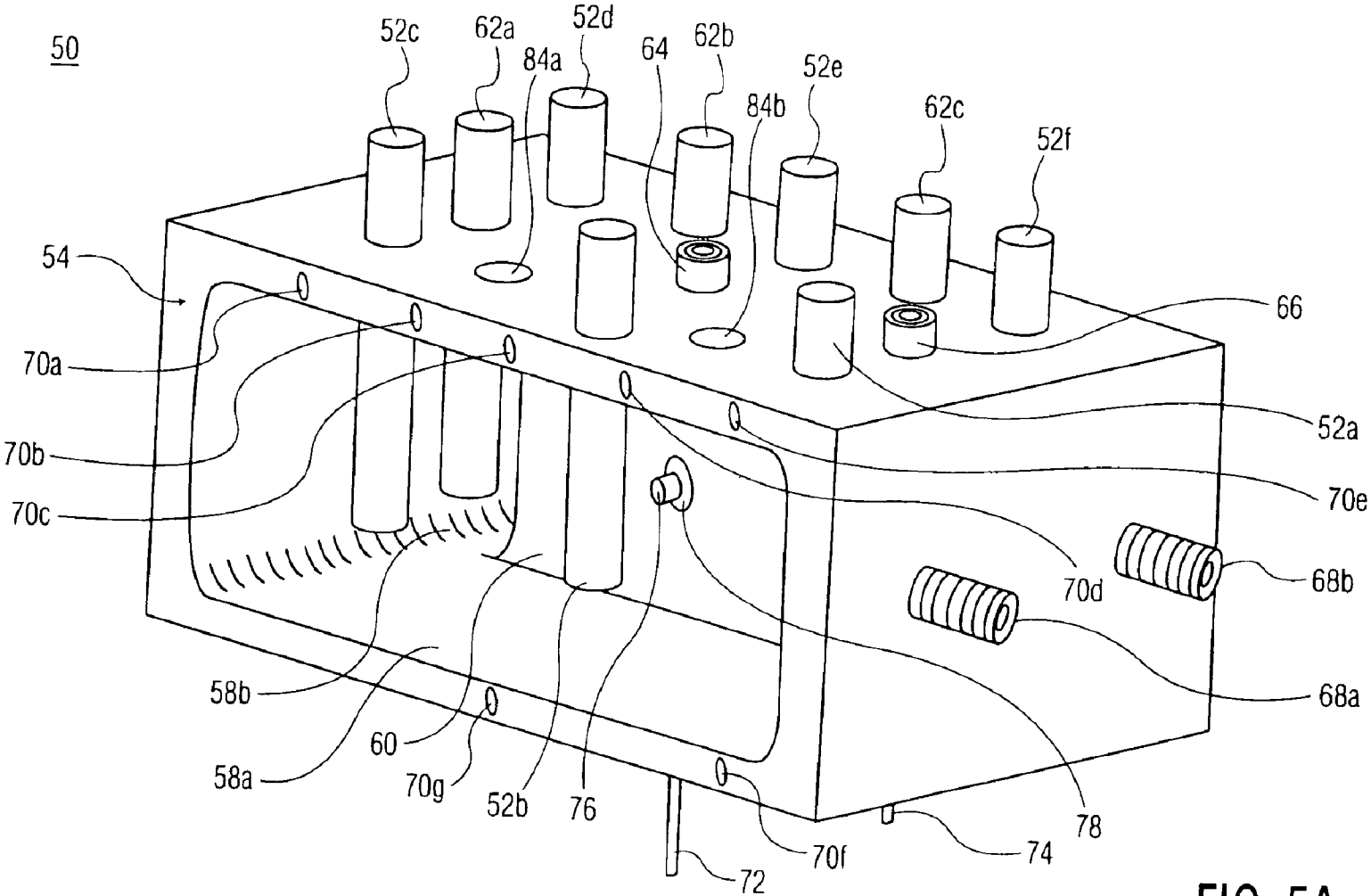
FIG. 5A is an exposed perspective view of a filtering system including two adjustable tunable couplers, in accordance with an embodiment of the present invention.
Figure 5B:
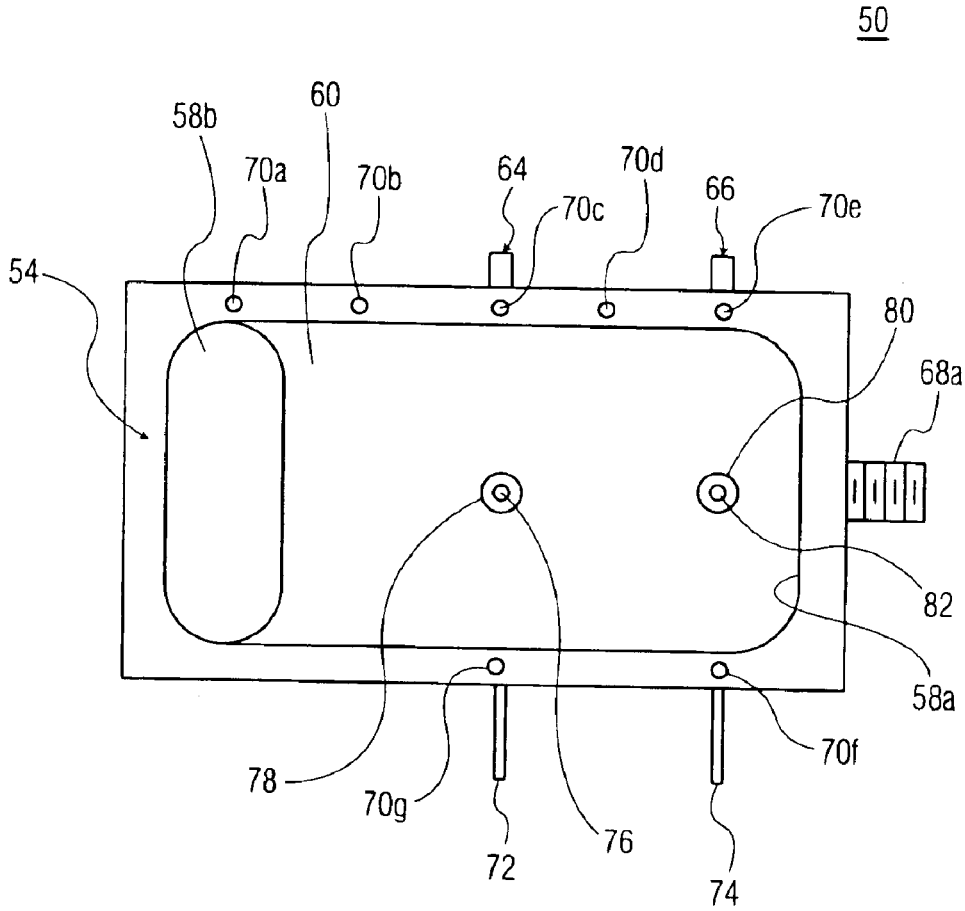
FIG. 5B is an exposed side view of the filtering system shown in FIG. 5A, in accordance with an embodiment of the present invention.
Figure 5C:
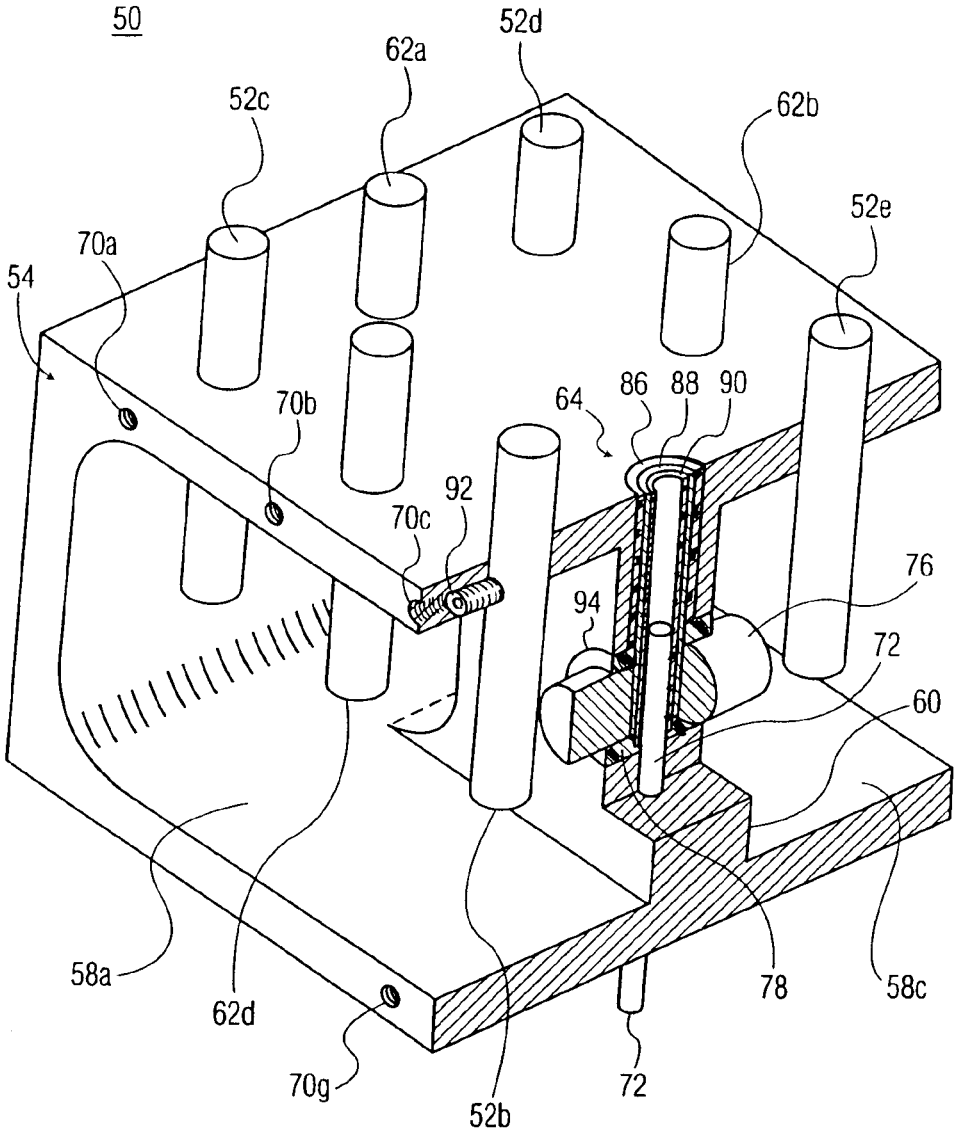
FIG. 5C is another exposed perspective view of the filtering system shown in FIG. 5A, including a cutaway, cross sectional view of one adjustable tunable coupler, in accordance with an embodiment of the present invention.

Filtering system 50, shown in FIGS. 5A, 5B and 5C is one embodiment of the present invention. As shown, filtering system 50 receives an input signal through connector 68*a* and generates a filtered output signal through connector 68*b*. The input signal is coupled from the input connector through a plurality of resonators that include resonating rods and bandwidth rods. Six resonating rods are shown designated, in a clockwise direction, as 52*a*, 52*b*, 52*c*, 52*d*, 52*e*, 52*f*. Also included are five bandwidth rods 62*a*, 62*b* and 62*c* (two rods are omitted for purposes of clarity).

Interleaved between resonating rods 52*a*, 52*b*, 52*c*, 52*d*, 52*e*, 52*f* are the bandwidth rods. Disposed between resonating rods 52*c* and 52*d* is bandwidth rod 62*a*. Disposed between resonating rods 52*d* and 52*e* is bandwidth rod 62*b*, and disposed between resonating rods 52*e* and 52*f* is bandwidth rod 62*c*. It will be appreciated that two additional bandwidth rods are disposed, respectively, between resonating rods 52*a* and 52*b* and between resonating rods 52*b* and 52*c*. These bandwidth rods are not shown, but are typically inserted in openings 84*a* and 84*b*.

The plurality of resonating rods and the plurality of bandwidth rods are disposed in housing 54. The housing is metallic and includes metallic septum (wall) 60 which divides waveguide section 58*a* from waveguide section 58*c* (best shown in FIG. 5C). Connecting waveguide section 58*a* and waveguide section 58*c* is waveguide section 58*b* (best shown in FIG. 5B).

The plurality of resonating rods and the interleaved plurality of bandwidth rods are disposed in the waveguide sections and circumvent septum 60. Although not shown, it will be understood that housing 54 includes a cover for forming waveguide section 58*a* and another cover for forming waveguide section 58*c*. Filtering system 50 is, thus, metallically enclosed, and provides a propagation path for a signal from input connector 68*a* to output connector 68*b*.

Filtering system 50, as will be explained, includes tunable coupler 64 and tunable coupler 66. Tunable coupler 64 is partially disposed in septum 60 and partially disposed between resonating rod 52*b* and resonating rod 52*e* (best shown in FIG. 5C). Similarly, tunable coupler 66 is partially disposed in septum 60 and partially disposed between resonating rod 52*a* and resonating rod 52*f* (tunable coupler 66 is omitted in FIG. 5C). It will be appreciated that the number of tunable couplers may vary in a filtering system. For example, a filtering system may include one tunable coupler, or more typically, may include 3 to 7 tunable couplers.

Referring to FIG. 5C, tunable coupler 64 includes horizontal probe 76 which is supported in iris 94 of septum 60. Horizontal probe 76 extends between resonating rod 52*b* and resonating rod 52*e* and is insulated from septum 60 by dielectric sleeve 78 that surrounds the horizontal probe.

Oriented substantially perpendicular to horizontal probe 76 is transverse tuning conductor 72. It will be appreciated that transverse tuning conductor 72 may be a center conductor of a conventional coaxial line. As shown in FIG. 5C, the coaxial line includes, in sequence from an outer diameter to an inner diameter, Teflon sleeve 86, coaxial shell 88, shrink tubing 90 and center conductor 72 (also referred to as transverse tuning conductor 72). Coaxial shell 88 and transverse tuning conductor 72 are both conductors, while Teflon sleeve 86 and shrink tubing 90 are both dielectrics.

Figure 7A:
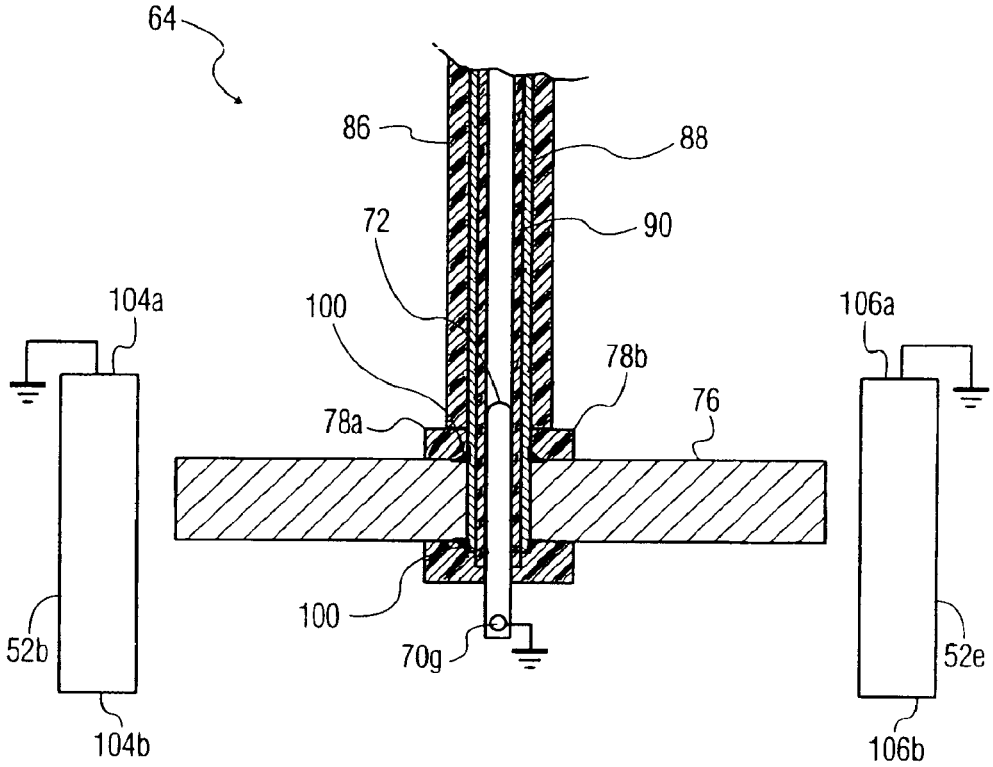
FIG. 7A is a cross sectional view of the adjustable tunable coupler shown in FIG. 6B, spanning between two resonating rods, in accordance with an embodiment of the present invention.

A transverse through hole in septum 60, and another transverse through hole in horizontal probe 76 are provided, as shown in FIGS. 5C and 7A, for receiving transverse tuning conductor 72 and its surrounding shrink tubing, coaxial shell and Teflon sleeve. As best shown in FIG. 7A, however, Teflon sleeve 86 does not go into the transverse through hole horizontal probe 76, but is cut short so that coaxial shell 88 may be exposed for soldering to horizontal probe 76.

Similar to tunable coupler 64, tunable coupler 66 is constructed in a similar manner. Although not shown in FIG. 5C, tunable coupler 66 is shown in FIGS. 5A and 5B and includes transverse tuning conductor 74, which is oriented transversely to horizontal probe 82 and dielectric sleeve 80.

Completing the description of FIGS. 5A, 5B and 5C, there is shown a plurality of openings, designated in a clockwise direction as 70*a*, 70*b*, 70*c*, 70*d*, 70*e*, 70*f*and 70*g*. It will be appreciated that each opening is sufficiently long to communicate with a respective resonating rod or bandwidth rod. A set screw is inserted into each opening for grounding the respective resonating rod or bandwidth rod. As shown, for example, in FIG. 5C, opening 70*c* receives set screw 92 for grounding resonating rod 52*b*. In a similar manner, opening 70*g* receives a set screw (not shown) for grounding transverse tuning conductor 72 (best shown in FIG. 6B). Similarly, opening 70*f* receives a set screw (not shown) for grounding transverse tuning conductor 74. It will be understood that housing 54 includes additional openings (not shown) for receiving set screws for grounding resonating rods 52*d*, 52*e* and 52*f* and bandwidth rods 62*a*, 62*b* and 62*c*.

Figure 6A:
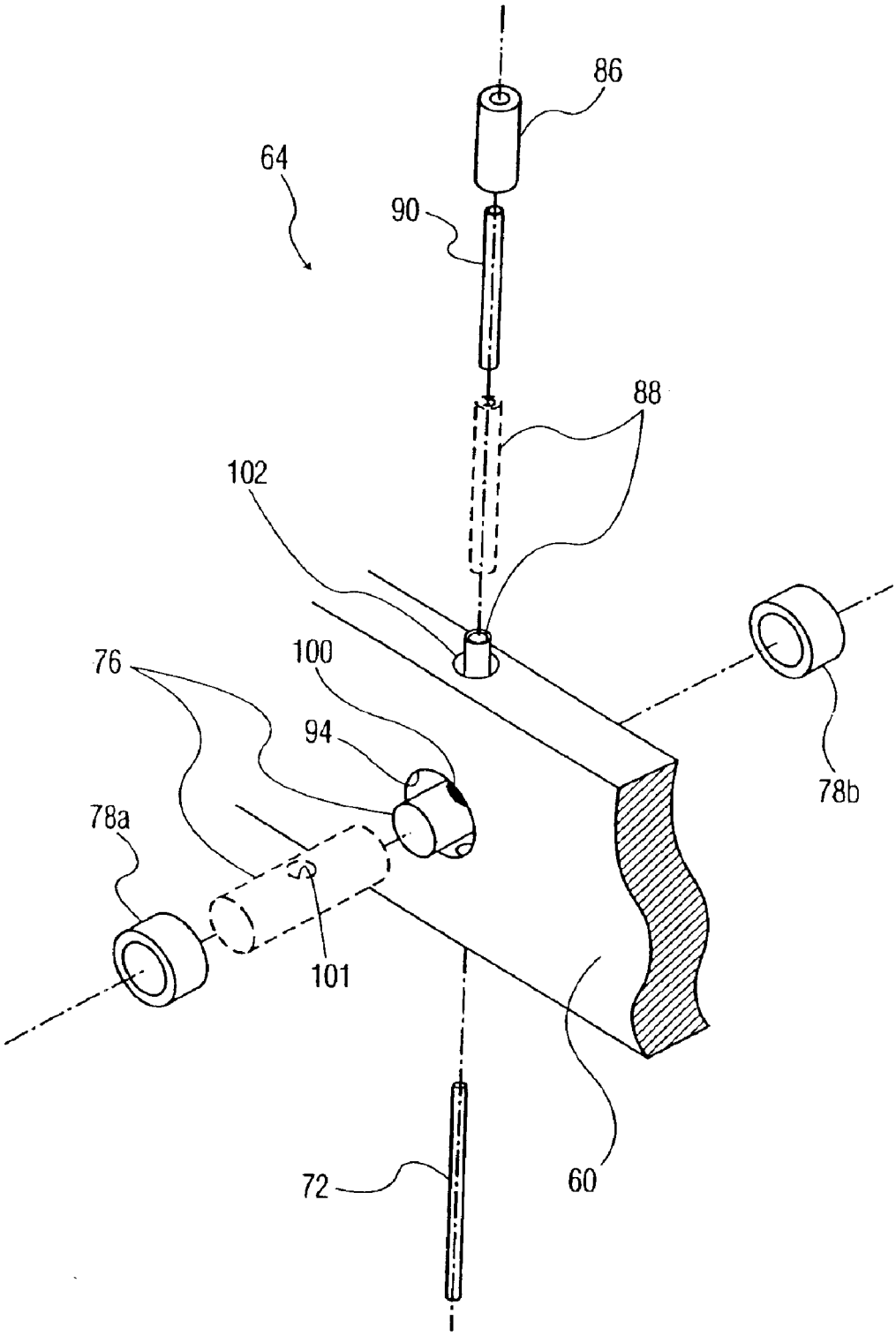
FIG. 6A is an exploded view of the adjustable tunable coupler shown in FIG. 5C, when inserted in transversely oriented through holes of a septum (wall), in accordance with an embodiment of the present invention.
Figure 6B:
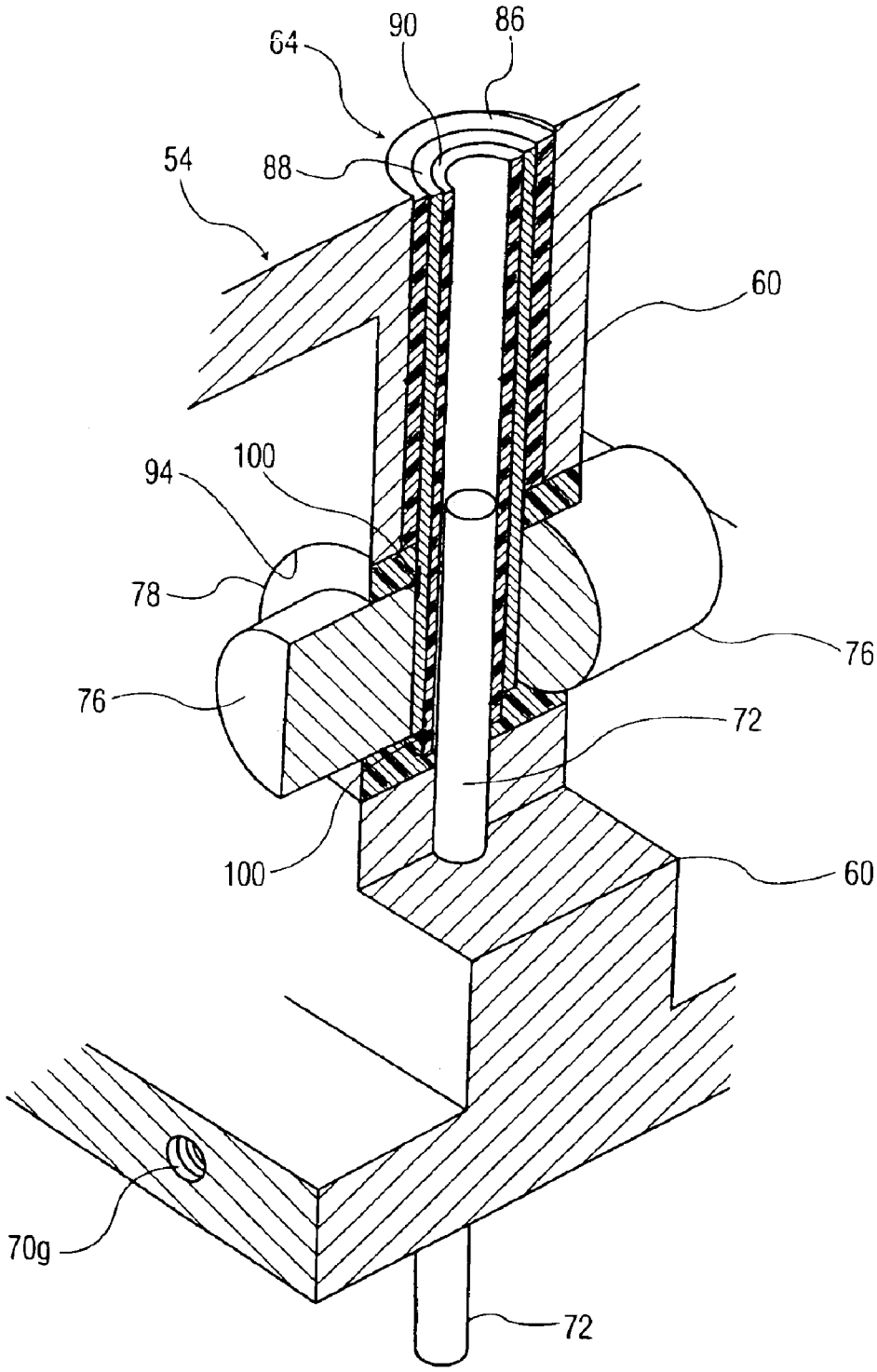
FIG. 6B is a perspective view of a cutaway of the adjustable tunable coupler shown in FIGS. 5C and 6A, in accordance with an embodiment of the present invention.

Referring next to FIGS. 6A and 6B, tunable coupler 64 is shown in greater detail. As shown, tunable coupler 64 includes horizontal probe 76, coupled between two resonating rods (not shown in FIGS. 6A and 6B), and includes transverse tuning conductor 72. Transverse tuning conductor 72 may be a center conductor of a conventional 0.085–10 coaxial, for example. Such coaxial, of course, is of 85 mils diameter and 10 ohm resistance. Transverse tuning conductor 72 is surrounded by shrink tubing 90, coaxial shell 88 and outer Teflon sleeve 86 (moving from an inside diameter to an outside diameter).

Horizontal probe 76, as shown, is inserted into iris 94 of septum 60 and is surrounded by dielectric Teflon sleeve 78, so that the horizontal probe is insulated from septum 60. As shown in FIG. 6A, Teflon sleeve 78 is divided into two sectional Teflon sleeves 78*a* and 78*b* for easier insertion into iris 94. Horizontal probe 76 includes transverse through hole 101 for receiving transverse tuning conductor 72, shrink tubing 90 and coaxial shell 88. Through hole 101 in horizontal probe 76 is aligned with through hole 102 in septum 60.

After exposing coaxial shell 88, by removing a portion of outer Teflon sleeve 86, coaxial shell 88 may be soldered to horizontal probe 76 with solder 100. In this manner, horizontal probe 76 is in electrical contact with coaxial shell 88. Transverse tuning conductor 72, however, is insulated from horizontal probe 76 by shrink tubing 90. Coaxial shell 88 is insulated from septum 60 by outer Teflon sleeve 86. In addition, horizontal probe 76 is insulated from septum 60 by dielectric Teflon sections 78*a* and 78*b*.

Transverse tuning conductor 72 may be moved up or down within shrink tubing 90, and up or down with respect to horizontal probe 76, in order to adjust the capacitive coupling, or the inductive coupling, between tunable coupler 64 and resonating rods 52*b* and 52*e*. After an adjustment is made, by moving transverse tuning conductor 72 up or down, tuning conductor 72 may be fixed in position by inserting a set screw (not shown) into hole 70*g* (FIG. 6B), so that the set screw pinches tuning conductor 72. The capacitive coupling or the inductive coupling is may, thus, be fixed. It will be appreciated that if it is desirable to again adjust the coupling, such adjustment may easily be done by loosening the set screw and again moving transverse tuning conductor 72 up or down.

Referring next to FIG. 7A, there is shown a cross sectional view of tunable coupler 64. As shown, tunable coupler 64 includes transverse tuning conductor 72 and horizontal probe 76. Transverse tuning conductor 72 is surrounded by shrink tubing 90, coaxial shell 88 and outer Teflon sleeve 86. The lower portion of tuning conductor 72, is exposed and free-of any shrink tubing, coaxial shell or outer Teflon sleeve, as it is moved downwardly within septum 60 for adjusting the capacitive or inductive coupling to the resonating rods. After adjusting the position of tuning conductor 72, the tuning conductor may be grounded by a set screw (not shown) by way of hole 70*g* (FIG. 6B).

Shown perpendicularly oriented to tuning conductor 72 is horizontal probe 76, which extends between resonating rod 52*b* and resonating rod 52*e*. Horizontal probe 76 is insulated from septum 60 (shown in FIG. 6B and not in FIG. 7A) by Teflon sleeve 78*a* and Teflon sleeve 78*b*. As also shown, coaxial shell 88 is soldered to horizontal probe 76 with solder 100. Resonating rod 52*b* is grounded by a set screw (not shown in FIG. 7A) that is inserted into hole 70*c* (shown in FIG. 5A), so that end 104*a* is grounded. The other end 104*b* of resonating rod 52*b* is open circuited. Similarly, resonating rod 52*e* is grounded by a set screw (not shown), so that end 106*a* is grounded and the other end 106*b* is open circuited.

Figure 7B:
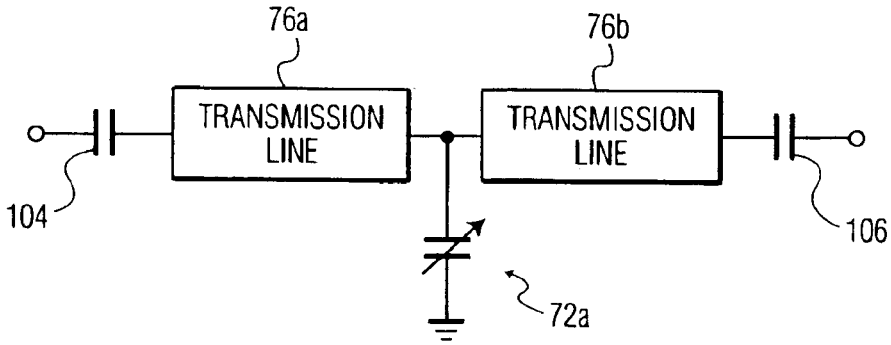
FIG. 7B is an equivalent circuit of the adjustable tunable coupler shown in FIG. 7A, in accordance with an embodiment of the present invention.

An equivalent circuit of tunable coupler 64, in relation to resonating rods 52*b* and 52*e*, is shown in FIG. 7B. As shown, horizontal probe 76 forms transmission line 76*a* in series with transmission line 76*b*. Transverse tuning conductor 72 is adjustable and forms variable capacitor 72*a* between transmission lines 76*a*, 76*b* and a ground potential. One end of horizontal probe 76 forms capacitor 104 with respect to resonating rod 52*b*. Similarly, another end of horizontal probe 76 and resonating rod 52*e* form capacitor 106, as shown.

Having described filtering system 50, as shown in FIGS. 5A, 5B, 5C, 6A, 6B, 7A and 7B, another embodiment of the present invention will now be described by referring to FIGS. 8, 9, 10A and 10B. While filtering system 50 includes tunable capacitive probes, the embodiment next described includes tunable inductive probes.

Figure 8:
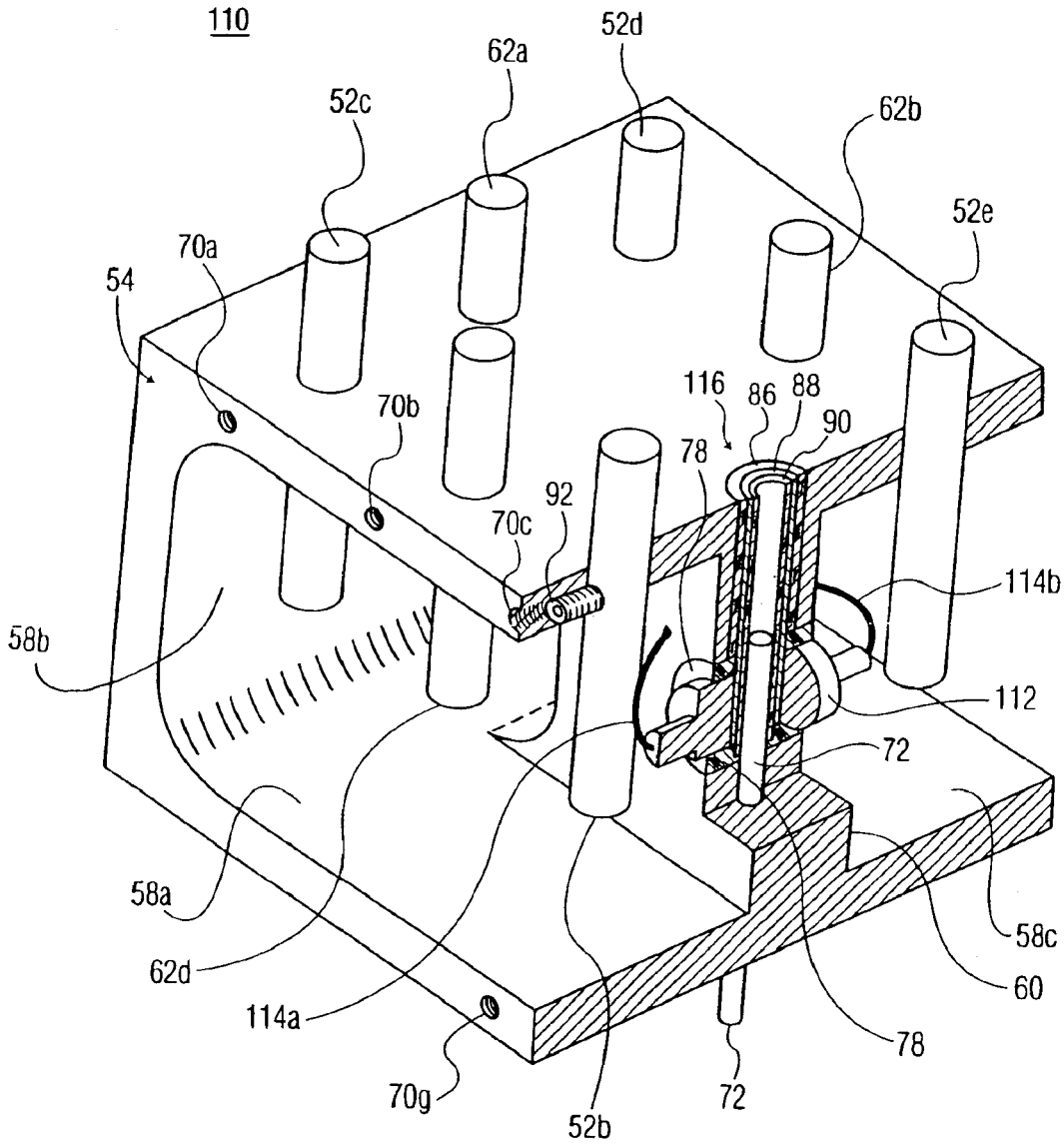
FIG. 8 is an exposed perspective view of another filtering system including a cutaway, cross sectional view of an adjustable tunable coupler, in accordance with another embodiment of the present invention.

Referring first to FIG. 8, there is shown filtering system 110. Filtering system 110, as shown, is constructed in a manner similar to the construction of filtering system 50. Elements of filtering system 110 that are similar to elements of filtering system 50 are designated with the same numerical designations as those of filtering system 50. A difference between filtering system 110 and filtering system 50 is that tunable coupler 116 is different from tunable coupler 64 of FIG. 5C.

Tunable coupler 116 is partially disposed in septum 60 and partially disposed in waveguide sections 58*a* and 58*b*. Tunable coupler 116 includes horizontal probe 112 extending between resonating rods 52*b* and 52*e*. Horizontal probe 112 is supported in iris 94 of septum 60, but is insulated from septum 60 by dielectric sleeve 78 surrounding the probe.

Figure 9:
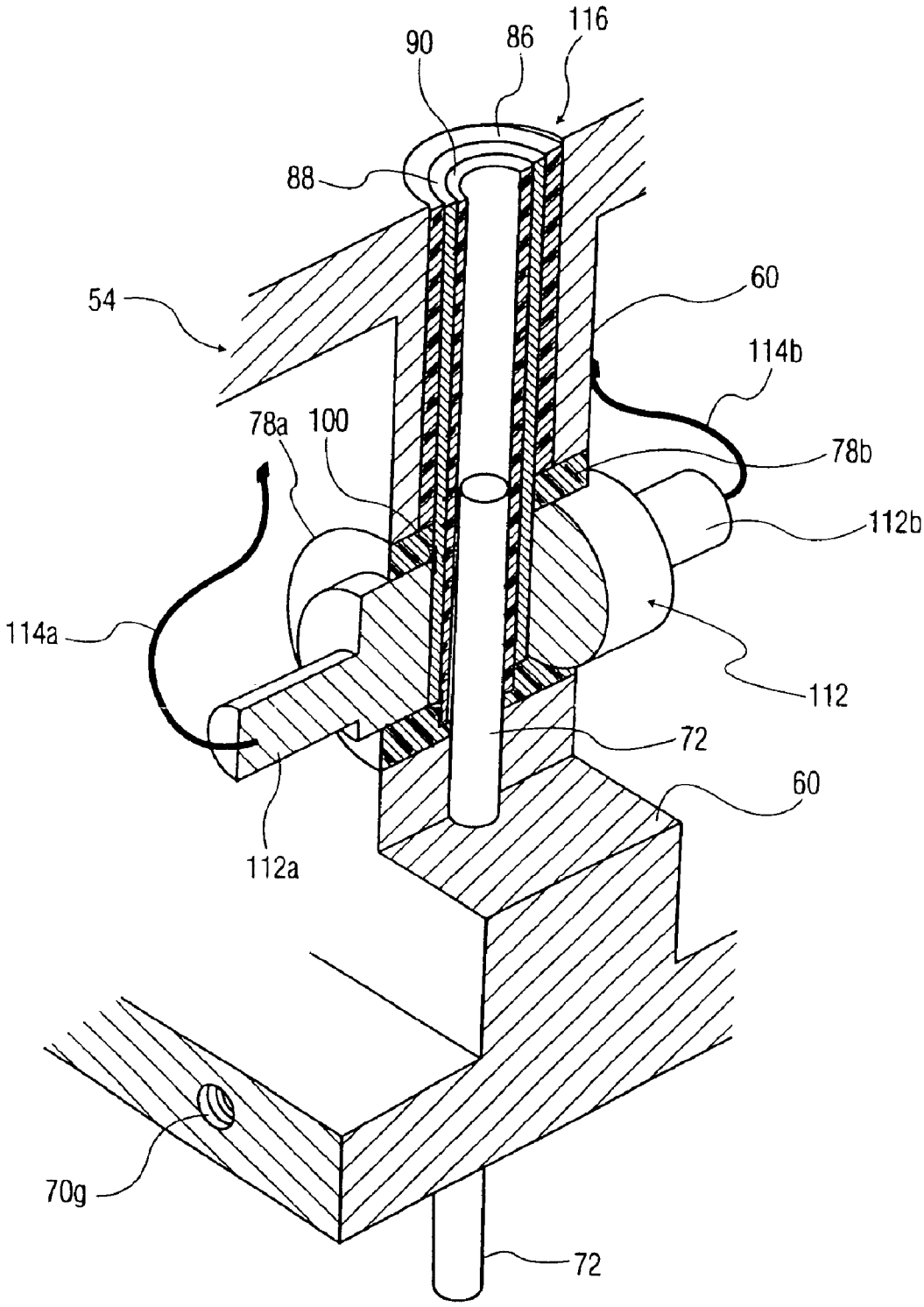
FIG. 9 is another exposed perspective view of the adjustable tunable coupler shown in FIG. 8, in accordance with an embodiment of the present invention.

Oriented substantially perpendicular to horizontal probe 112 is transverse tuning conductor 72. It will be appreciated that tuning conductor 72 may be a center conductor of a conventional coaxial line. As best shown in FIG. 9, the coaxial line includes, in sequence from an outer diameter to an inner diameter, Teflon sleeve 86, coaxial shell 88, shrink tubing 90 and center conductor 72 (also referred to as tuning conductor 72, or transverse tuning conductor 72). Coaxial shell 88 and tuning conductor 72 are both conductors, while Teflon sleeve 86 and shrink tubing 90 are both dielectrics. Tuning conductor 72 may be a center conductor of a conventional 0.085–10 coaxial, for example. Such coaxial is of 85 mils diameter and 10 ohm resistance.

A through hole in septum 60 and another through hole in horizontal probe 112 are provided, as shown in FIG. 9 (and similar to that shown in FIG. 6B) for receiving tuning conductor 72 with its surrounding shrink tubing, coaxial shell and Teflon sleeve. Teflon sleeve 86, however, does not go through horizontal probe 112, but is cut short, so that coaxial shell 88 may be exposed for soldering to horizontal probe 112 using solder 100.

Horizontal probe 112 includes a wide diameter at its center portion (not labeled) and a narrow diameter at its respective outer portions 112*a* and 112*b*. It will be appreciated, however, that transverse probe 112 need not have sections of differing diameters but may include one diameter section only, similar to the previously described transverse probe 76 of filtering system 50. It will be understood that a large diameter section lowers the impedance, whereas a narrow diameter section raises the impedance.

As best shown in FIG. 9, narrow portion 112*a* of horizontal probe 112 is connected electrically to septum 60 by way of wire loop 114*a*. In a similar manner, narrow portion 112*b* of horizontal probe 112 is electrically connected by way is of another loop wire 114*b* to septum 60. Such connections may be done by soldering methods.

Figure 10A:
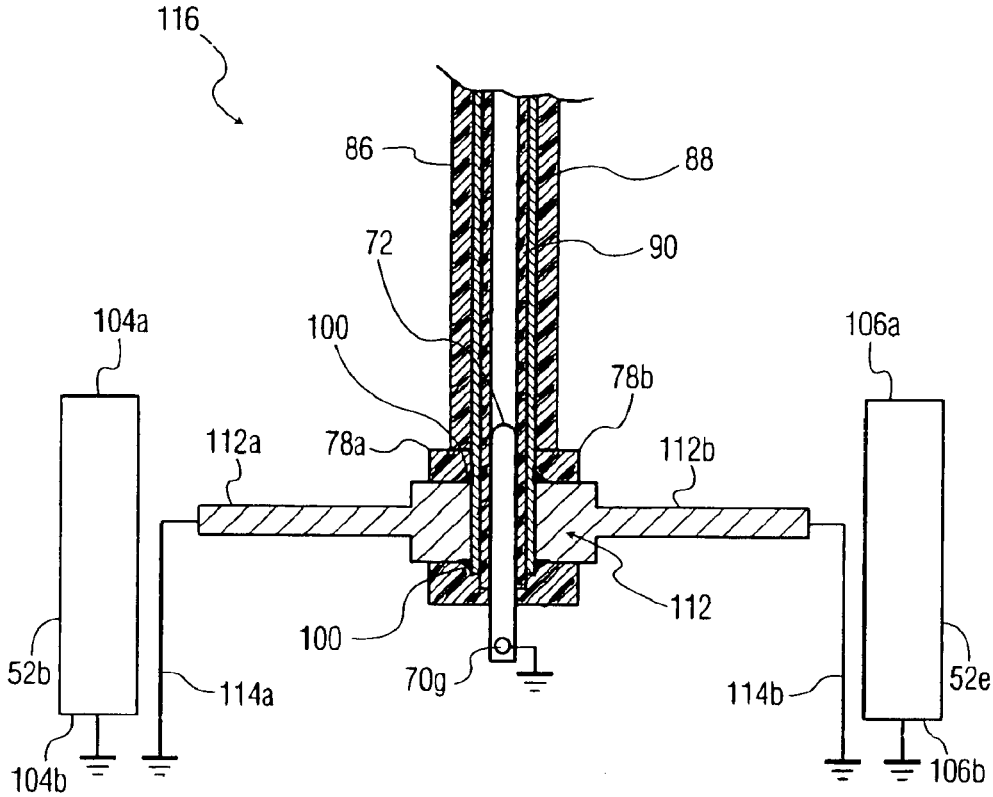
FIG. 10A is a cross sectional view of the adjustable tunable coupler Is shown in FIGS. 8 and 9, spanning between two resonating rods, in accordance with an embodiment of the present invention.

Referring next to FIG. 10A, there is shown a sectional view of tunable coupler 116. As shown, tunable coupler 116 includes tuning conductor 72 and horizontal probe 112. Tuning conductor 72 is surrounded by shrink tubing 90, coaxial shell 88 and outer Teflon sleeve 86. The lower portion of tuning conductor 72 is exposed and free-of any shrink tubing, coaxial shell or outer Teflon sleeve, as it has been moved downwardly within shrink tubing 90 and within septum 60 for adjusting the capacitive or inductive coupling of the resonators. After adjusting the position of tuning conductor 72, the tuning conductor may be grounded by a set screw (not shown) by way of a hole 70*g* (FIG. 9).

Horizontal probe 112 is electrically insulated from septum 60 (shown in FIGS. 8 and 9) by Teflon sleeve section 78*a* and Teflon sleeve section 78*b*. As also shown, coaxial shell 88 is soldered to horizontal probe 112 by solder 100. As further shown in FIG. 10A, resonating rod 52*b* is grounded by a set screw (not shown in FIG. 10A) inserted into hole 70*c* (shown in FIG. 8), so that end 104*b* becomes grounded. The other end 104*a* of resonating rod 52*b* is open circuited. Similarly, resonating rod 52*e* is grounded by a set screw (not shown), so that end 106*b* becomes grounded and the other end 106*a* is open circuited. Furthermore, outer portion 112*a* of horizontal probe 112 is grounded by loop wire 114*a*, and outer portion 112*b* of horizontal probe 112 is grounded by loop wire 114*b*.

Figure 10B:
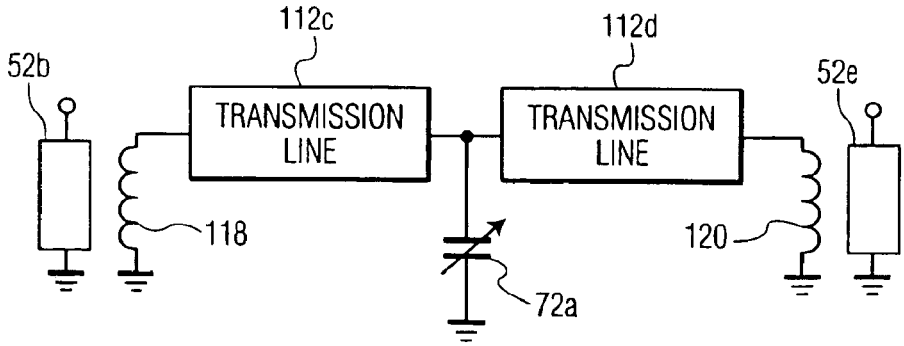
FIG. 10B is an equivalent circuit of the adjustable tunable copier shown in FIG. 10A, in accordance with an embodiment of the present invention.

An equivalent circuit of tunable coupler 116 in relation to resonating rods 52*b* and 52*e* is shown in FIG. 10B. As shown, horizontal probe 112 forms transmission line 112*c* in series with transmission line 112*d*. Tuning conductor 72 forms variable capacitor 72*a*, which is connected between transmission line 112*c*, 112*d* and a ground potential of the septum and housing. One end of horizontal probe 112 having wire loop 114*a* forms coil 118 with respect to resonating rod 52*b*. Similarly, outer portion 112*b* of horizontal probe 112 having wire loop 114*b* forms coil 120 with respect to resonating rod 52*e*, as shown.

It will be understood that filtering systems 50 and 110 includes a plurality of resonators. Each resonator results from a combination of inductance and capacitance. The inductance, for example, results from the open rectangular area or waveguide section with a resonating rod disposed therein. The capacitance, for example, results from an end of the horizontal probe interacting with the resonating rod, as previously described.

The equivalent circuits, depicted in FIGS. 7B and 10B, show that each of the tunable couplers acts as a voltage divider, reducing the available capacitively coupled energy or inductively coupled energy between resonators. The present invention accomplishes this by coupling the transmission lines, formed by horizontal probes 76 and 112, via the capacitive elements, shown in shunt to ground, namely variable capacitor 72*a* (shown in FIG. 7B) and a similar variable capacitor 72*a* (shown in FIG. 10B).

The initial adjustment of the coupling sets the maximum possible value, and is based on the closest practical proximity of the resonating rods to either the end of the horizontal probe or the loop at the end of the horizontal probe. Then, the coupling may be reduced to a desired value, using the tuning conductor as a variable capacitor, and grounding the excessive coupling so that a desired value of inter resonator coupling may be achieved.

The tunable coaxial section includes a short length of a low impedance coaxial line, typically a 10 ohm impedance coaxial line. This commercially available coaxial line may be chosen to be at a low impedance level, so as to function as a capacitance connected across the horizontal probe to a ground potential. The combination acts as a voltage divider. If a unit excitation is applied between one resonator and either the capacitive horizontal probe or the inductive loop at one end, then less than the unit excitation is available at the other end of the horizontal probe or the inductive loop. This voltage reduction is inversely proportional to the value of the tunable capacitance (larger tunable capacitance means less coupled signal, because more signal is grounded through the tunable capacitor).

Typical applications of these tunable couplers are in filter designs requiring coupling between non-sequential or non-adjacent resonators. These are common in communication applications in which close-in finite frequency transmission zeros are required for stopband attenuation, or in which passband group delays must be flattened to avoid distortion. In the first case, filters designed to have inductive (or capacitive) coupling between sequential or adjacent resonators are made to include capacitive (or inductive) cross coupling between non-adjacent resonators. For the group delay flattening types, filters designed to have inductive (or capacitive) sequential or adjacent resonator couplings are made to include inductive (or capacitive) cross couplings.

Combinations of the two cross coupling types are also quite common, and practical filters may use 3 to 7 cross coupling networks. Thus, tuning is difficult, and without the means to adjust the cross-coupling circuits, tuning is extremely time consuming. The tunable couplers of the present invention advantageously save time in designing the filter and tuning the filter. It will be appreciated that the tunable couplers of the present invention may also be used to adjust the coupling between sequential or adjacent resonators, if desired. The new tunable couplers do not replace the resonated evanescent line couplings, but act in concert to provide tunable couplings for values and in locations not easily achievable through any other means.

Figure 11:
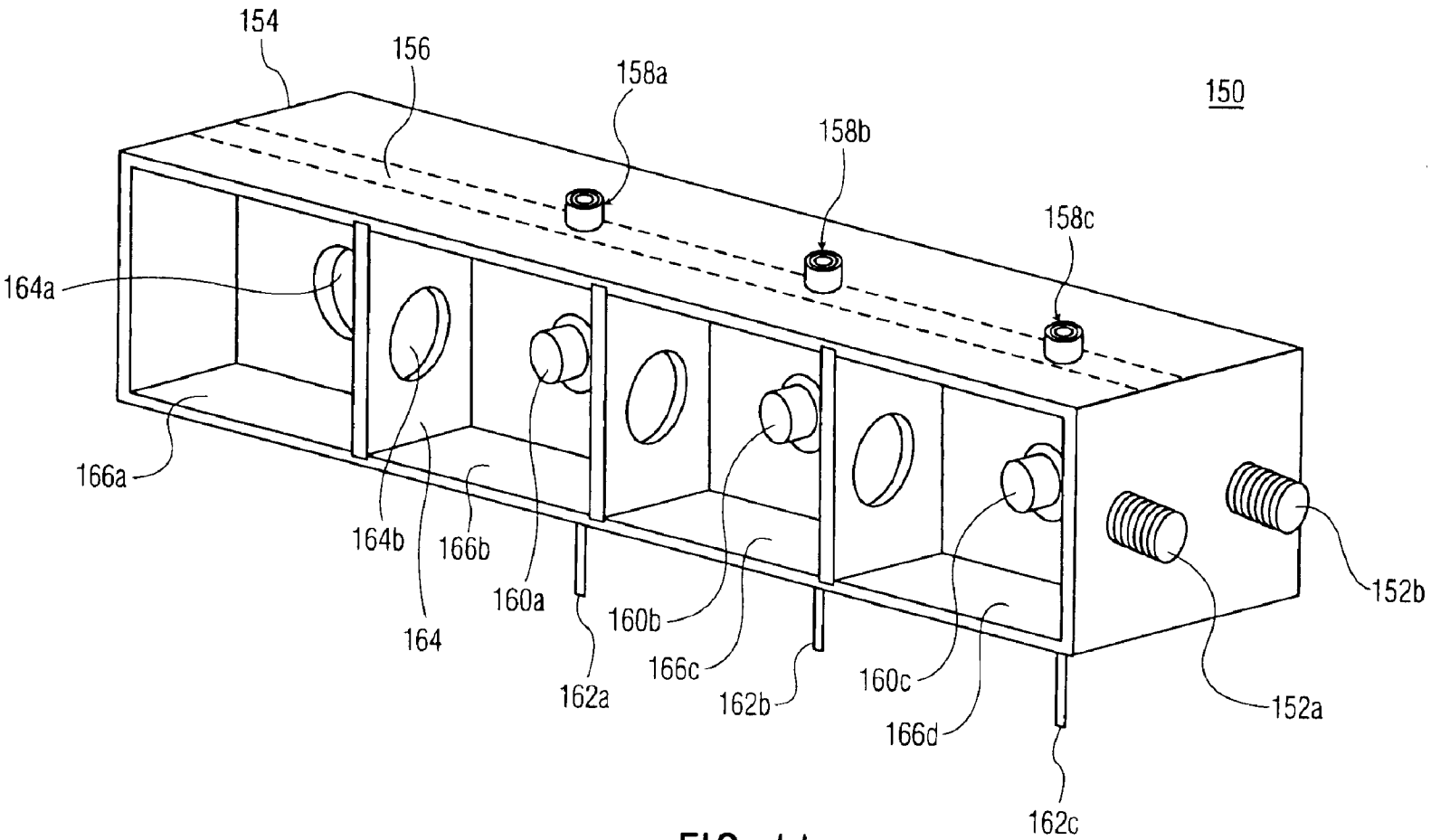
FIG. 11 is an exposed perspective view showing yet another filtering system having resonator cavities, including three adjustable tunable couplers, in accordance with an embodiment of the present invention.
Figure 12:
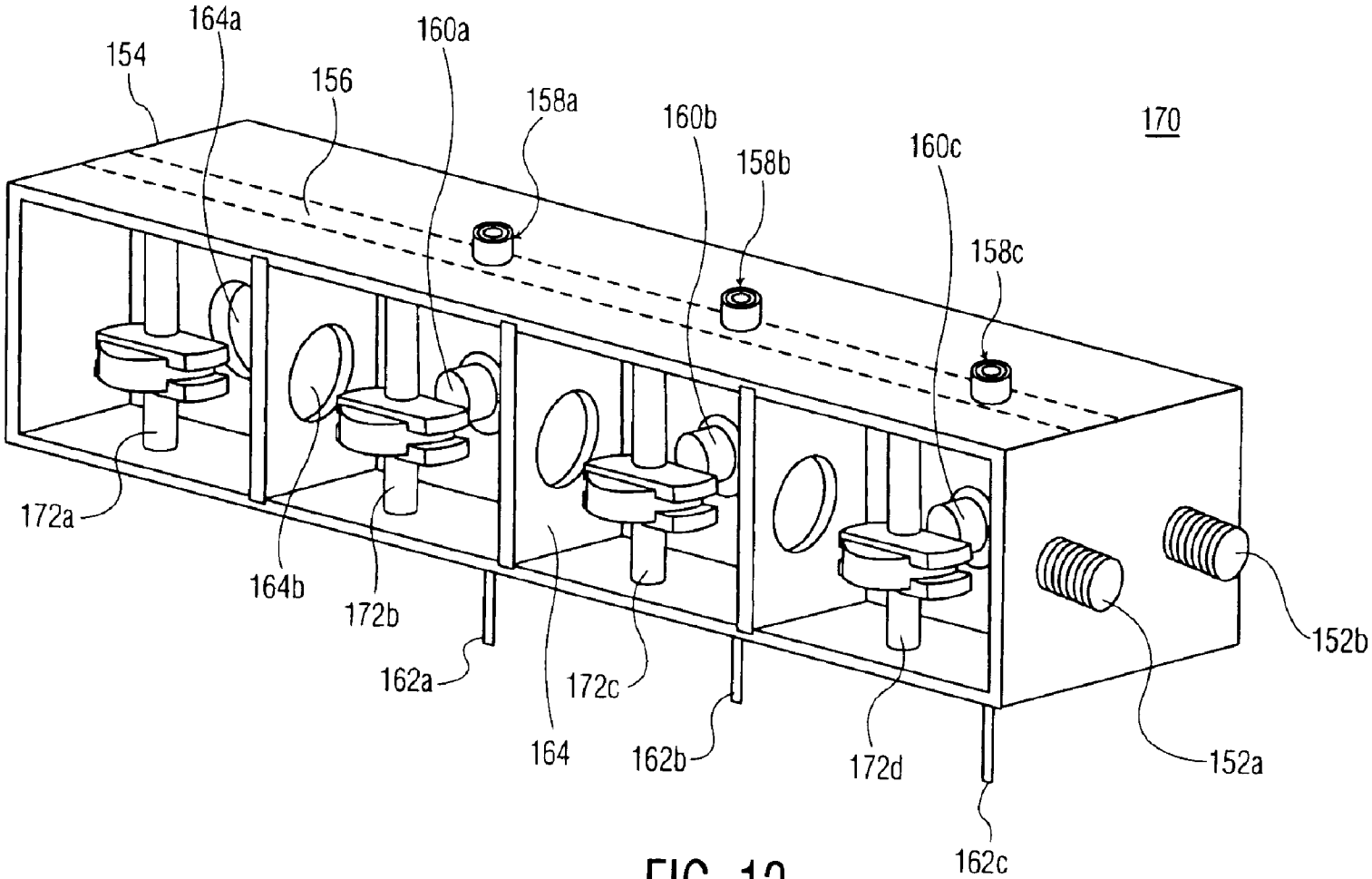
FIG. 12 is an exposed perspective view showing still another filtering system having dielectric resonators, including three adjustable tunable couplers, in accordance with an embodiment of the present invention.

Referring next to FIGS. 11 and 12 there are shown two additional embodiments of the present invention. FIG. 11 shows filtering system 150 including housing 154 containing four waveguide cavity resonators 166*a*–166*d*. Each waveguide cavity resonator is separated by iris plate 164 including opening 164*b*. As a folded waveguide, filtering system 150 includes four additional waveguide cavities on the opposite side of waveguide cavities 166*a*–166*d*. The four waveguide cavities 166*a*–166*d* are separated from the other four waveguide cavities (not shown) by septum wall 156. Septum wall 156 also includes iris opening 164*a*, similar to iris opening 164*b*.

Filtering system 150 includes input connector 152*a* and output connector 152*b*. Input connector 152*a* receives a signal which propagates sequentially through each of the cavity resonators and is output at output connector 152*b*. The signal is directly coupled between one cavity resonator and its adjacent cavity resonator by way of the iris opening disposed between the respective cavity resonators. The signal is also cross coupled between a cavity resonator and another cavity resonator, separated by septum wall 156. This cross coupling is achieved by a respective tunable coupler disposed between the cavity resonators, in accordance with the present invention.

Three tunable couplers are shown, each partially disposed within septum 156 and partially disposed within two opposing cavity resonators. As shown, tunable coupler 158*a* includes horizontal probe 160*a* and transverse tuning conductor 162*a*. Similarly, tunable coupler 158*b* includes horizontal probe 160*b* and transverse tuning conductor 162*b*. In addition, tunable coupler 158*c* includes horizontal probe 160*c* and transverse tuning conductor 162*c*.

It will be appreciated that tunable couplers 158*a*–158*c* may be constructed similarly to tunable coupler 64 shown, for example, in FIG. 6*b*, or may be constructed similarly to tunable coupler 116 shown, for example, in FIG. 9. In a manner similar to tunable couplers 116 or 64, tunable couplers 158*a*–158*c* may be adjusted by moving tuning conductors 162*a*–162*c* up or down. After tuning adjustments, set screws (not shown) are used to fix the tuning conductors into set positions.

Referring next to FIG. 12, there is shown yet another embodiment of the present invention, designated generally as filtering system 170. Filtering system 170 includes components similar to those shown in FIG. 11 and, as such, have been designated with similar designations.

Similar to the embodiment shown in FIG. 11, filtering system 170 includes eight cavities of which four are shown and an opposing four are not shown. Included in the four shown cavities are, respectively, dielectric resonators 172*a*–172*d*. Four similar dielectric resonators are included in the four cavities (not shown) on the opposite side of septum 156. As such, filtering system 170 includes eight dielectric resonators.

A signal is directly coupled between one dielectric resonator and its adjacent dielectric resonator by way of the iris opening disposed between the respective dielectric resonators. The signal is also cross coupled between a dielectric resonator and another dielectric resonator, separated by septum wall 156. This cross coupling is achieved by a respective tunable coupler disposed between the dielectric resonators, in accordance with the present invention.

Disposed between three dielectric resonators and their respective opposing three dielectric resonators (not shown) there is shown three tunable couplers 158*a*–158*c*. In a manner similar to tunable couplers 116 or 64, tunable couplers 158*a*–158*c* may be adjusted by moving tuning conductors 162*a*–162*c* up or down. After tuning adjustments, set screws (not shown) are used to fix the tuning conductors into set positions.

Figure 13:
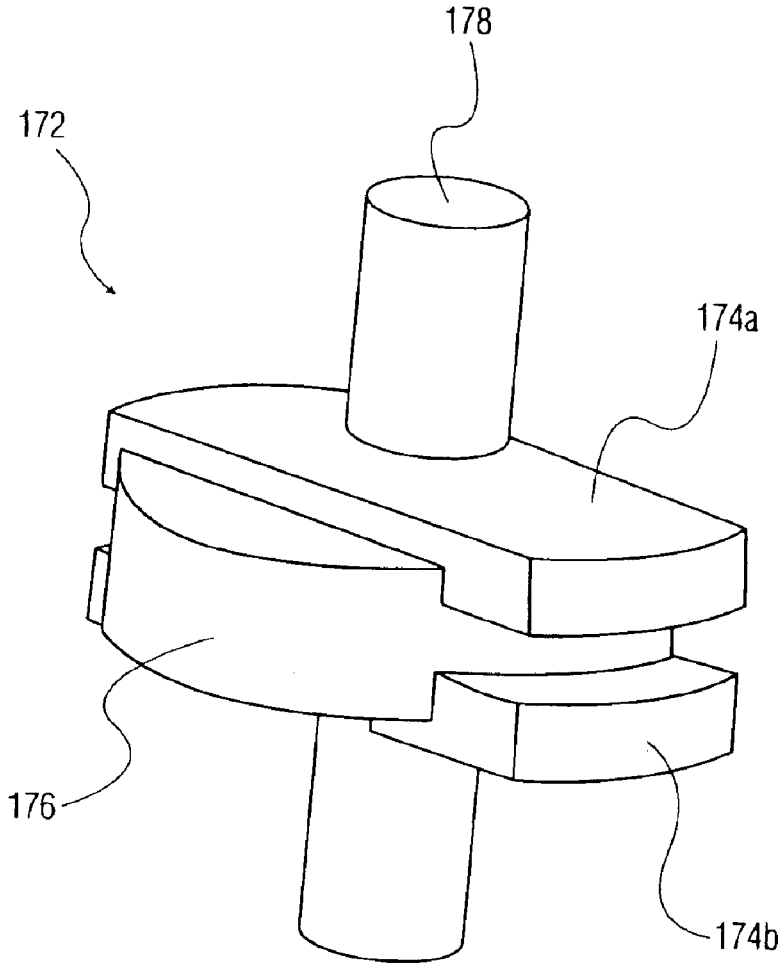
FIG. 13 PRIOR ART
FIG. 13 is a perspective view of a conventional dielectric resonator.

Dielectric resonator 172 is shown in greater detail in FIG. 13. As shown, dielectric resonator 172 includes resonating rod 178 and dielectric resonator section 176 sandwiched between upper support 174*a* and lower support 174*b*.

It will be appreciated that the present invention includes a tunable coupler that is disposed between two resonators. These resonators may each include a combination of a waveguide section and a resonating rod as shown, for example, in FIGS. 5C and 8. These type of resonators may be referred to as evanescent resonators. In another embodiment, the resonators may be waveguide cavity resonators, such as those shown, for example, in FIG. 11. In yet another embodiment, the resonators may be dielectric resonators, such as those shown, for example, in FIG. 12.

Each of these resonators, or other types of resonators may include a tunable coupler that has a horizontal probe and an adjustable transverse tuning conductor, as described. While three kinds of resonators have been described, the invention is not intended to be limited to only the three types of resonators described but may include other types of resonators.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed:

1. A filtering system having a stationary probe for coupling two resonators comprising an iris having the stationary probe disposed therein fixedly coupled between the two resonators; and the stationary probe having a transverse opening for receiving a moveable tuning conductor, wherein the moveable tuning conductor provides adjustable coupling between the two resonators.

2. The system of claim 1 wherein the tuning conductor is grounded at one end and provides a capacitive coupling to ground between the two resonators.

3. The system of claim 1 wherein the tuning conductor is transversely oriented to the probe, and fixedly movable in the transverse opening of the probe to provide an adjustable capacitance between the two resonators.

4. The system of claim 1 wherein the tuning conductor is a center conductor of a coaxial line.

5. The system of claim 4 wherein the coaxial line includes an outer dielectric sleeve, a coaxial shell, and a shrink tubing, each surrounding the tuning conductor.

6. The system of claim 1 wherein the tuning conductor is electrically insulated from the probe by a dielectric material.

7. The system of claim 1 wherein the tuning conductor is inserted in a transverse opening in a septum separating the two resonators, and the transverse opening of the septum is aligned to the transverse opening of the probe.

8. The system of claim 1 wherein the tuning conductor is surrounded by a coaxial shell, the coaxial shell electrically connected to the probe, and the probe is electrically insulated from the tuning conductor.

9. The system of claim 1 wherein each of the two resonators includes a corresponding resonating rod disposed in a respective waveguide section.

10. The system of claim 1 wherein each of the two resonators includes a respective waveguide cavity.

11. The system of claim 1 wherein each of the two resonators includes a respective dielectric resonator.

12. The system of claim 1 wherein the tuning conductor is adjustably fixed with respect to the probe by a set screw.

13. The system of claim 1 wherein the probe includes an end disposed in one of the two resonators, and the end of the probe and the one resonator form a capacitor.

14. The system of claim 1 wherein the probe includes an end disposed in one of the two resonators, and the end of the probe is coupled to a ground potential by a wire loop, the wire loop forming a coil.

15. A filtering system having a plurality of resonators comprising at least one stationary probe fixedly extending between two resonators of the plurality of resonators, and a moveable tuning conductor transversely oriented to the stationary probe, wherein the moveable tuning conductor provides adjustable coupling between the two resonators.

16. The system of claim 15 wherein the tuning conductor is grounded at one end and provides a variable capacitance to ground between the two resonators.

17. The system of claim 15 wherein the tuning conductor is received in a transverse opening of the probe, and the tuning conductor is electrically insulated from the probe.

18. The system of claim 15 wherein the two resonators are separated by a septum, and the septum includes an iris for supporting the probe between the two resonators.

19. The system of claim 15 wherein each of the two resonators includes a corresponding resonating rod disposed in a respective waveguide section.

20. The system of claim 15 wherein each of the two resonators includes a corresponding dielectric resonator disposed in a respective resonating cavity.

21. The system of claim 15 wherein each of the two resonators includes a respective resonating cavity.

* * * * *